US006190183B1

(12) United States Patent
Yang et al.

(10) Patent No.: US 6,190,183 B1
(45) Date of Patent: Feb. 20, 2001

(54) ELECTRICAL CONNECTOR

(75) Inventors: Johnson Yang, Tai-Shan; Tai Zin, Shu-Lin, both of (TW)

(73) Assignee: Hon Hai Precision Ind. Co., Ltd., Taiepi Hsien (TW)

( * ) Notice: Under 35 U.S.C. 154(b), the term of this patent shall be extended for 0 days.

(21) Appl. No.: 09/427,505

(22) Filed: Oct. 26, 1999

(30) Foreign Application Priority Data

Nov. 24, 1998 (TW) ..... 87219532

(51) Int. Cl.[7] ..... H01R 13/73
(52) U.S. Cl. ..... 439/79; 439/567
(58) Field of Search ..... 439/79, 567, 571, 439/572

(56) References Cited

U.S. PATENT DOCUMENTS 5,738,541 * 4/1998 Tseng ..... 439/567
5,876,222 * 3/1999 Gardner et al. ..... 439/79

* cited by examiner

*Primary Examiner*—Gary F. Paumen
(74) *Attorney, Agent, or Firm*—Wei Te Chung

(57) ABSTRACT

An electrical connector comprises an insulative housing, a plurality of terminals and a pair of board locks. The terminals include upper terminals and lower terminals each having a contact end, a securing portion and a solder tail. The solder tail of each lower terminal is substantially perpendicular to a circuit board and soldered to soldering sites located on a lower surface thereof using Through Hole Technology. The solder tail of each upper terminal is substantially parallel to the circuit board and soldered to soldering sites located on an upper surface thereof using Surface Mount Technology.

5 Claims, 5 Drawing Sheets

ELECTRICAL CONNECTOR

BACKGROUND OF THE INVENTION

The present invention relates to an electrical connector, and particularly to an electrical connector having one row of terminals soldered to a top surface of a circuit board and another row of terminals soldered to a bottom surface of the circuit board.

An electrical connector is commonly mounted on a circuit board for electrical connection purpose. A plurality of terminals of the connector electrically connects with corresponding circuit of the circuit board by soldering.

Referring to FIG. 1, a conventional connector disclosed in Taiwan Patent Application No. 85213592 comprises an insulative housing 4 and a plurality of terminals 20 retained in the housing 4. Each terminal 20 includes an arcuate contact end 201, a securing portion 202 and a solder tail 203. The solder tail 203 is bent to be parallel to a circuit board (not shown) and soldered to soldering conductive pad or lead located on an upper surface using Surface Mount Technology.

FIG. 2 shows another conventional connector disclosed in Taiwan Patent Application No. 84104534. The connector has a plurality of terminals 30 each including an arcuate contact end 301, a securing portion 302 and a solder tail 303. The solder tail 303 is substantially perpendicular to a circuit board (not shown) and soldered thereto using Through Hole Technology with solder sites located on a lower surface of the circuit board.

Nowadays, a connector tends to accommodate as many terminals as possible due to an increase in signal transmission frequency. In the prior art, a soldering process is performed on only one side of a circuit board so that a high density of soldering sites are provided on the circuit board thereby impeding the soldering process of the terminals and adversely affecting soldering quality.

In addition, a connector is required to be fixed on a circuit board by board locks before undergoing wave soldering. As shown in FIG. 2, a board lock 33 assembled to the connector comprises a retaining portion 331 and a pair of locking legs 332. The retaining portion 331 is received in an insulative housing of the connector and the locking legs 332 are inserted into a hole of a circuit board thereby securing the connector to the circuit board. However, the locking legs 322 engage with the hole only along opposite edges thereof so that such a connection is not reliable.

SUMMARY OF THE INVENTION

Accordingly, a primary object of the present invention is to provide an electrical connector having a row of terminals soldered to a top surface of a circuit board and another row of terminals soldered to a bottom surface of the circuit board.

A second object of the present invention is to provide an electrical connector having board locks which reliably secure the connector to a circuit board.

To fulfill the above-mentioned objects, an electrical connector in accordance with the present invention comprises an insulative housing, a plurality of terminals and a pair of board locks. The terminals include upper terminals and lower terminals each having a contact end, a securing portion and a solder tail. The solder tail of each lower terminal is substantially perpendicular to a circuit board and soldered to soldering sites located on a lower surface thereof using Through Hole Technology. The solder tail of each upper terminal is substantially parallel to the circuit board and soldered to soldering sites located on an upper surface thereof using Surface Mounting Technology. Since the solder tails of the upper terminals and lower terminals are soldered to opposite surfaces of the circuit board, the solder sites are not arranged in a high density thereby facilitating the soldering process.

According to one aspect of the present invention, each board lock includes a U-shaped retaining portion and a pair of locking legs each having an arcuate surface for fully engaging with an inner surface of a hole of the circuit board thereby reliably securing the connector to the circuit board.

DETAILED DESCRIPTION OF THE INVENTION

Figure 1:
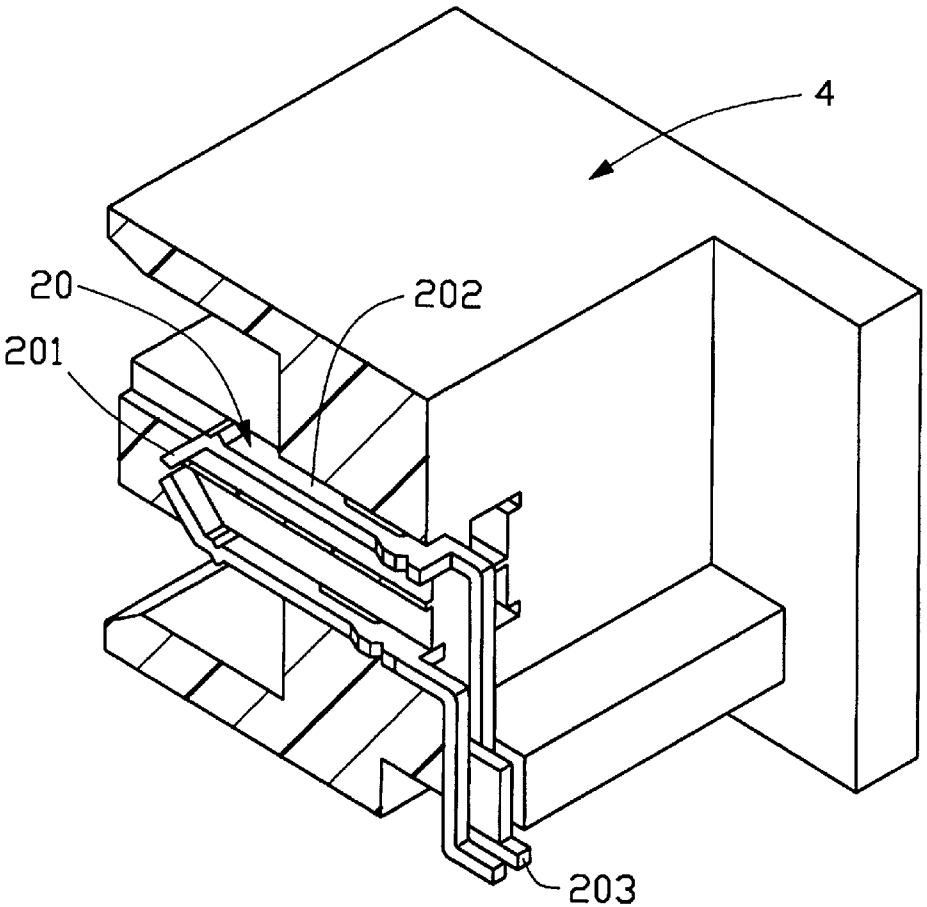
FIG. 1 (PRIOR ART)
FIG. 1 is a perspective and cross-sectional view of a conventional connector.
Figure 2:
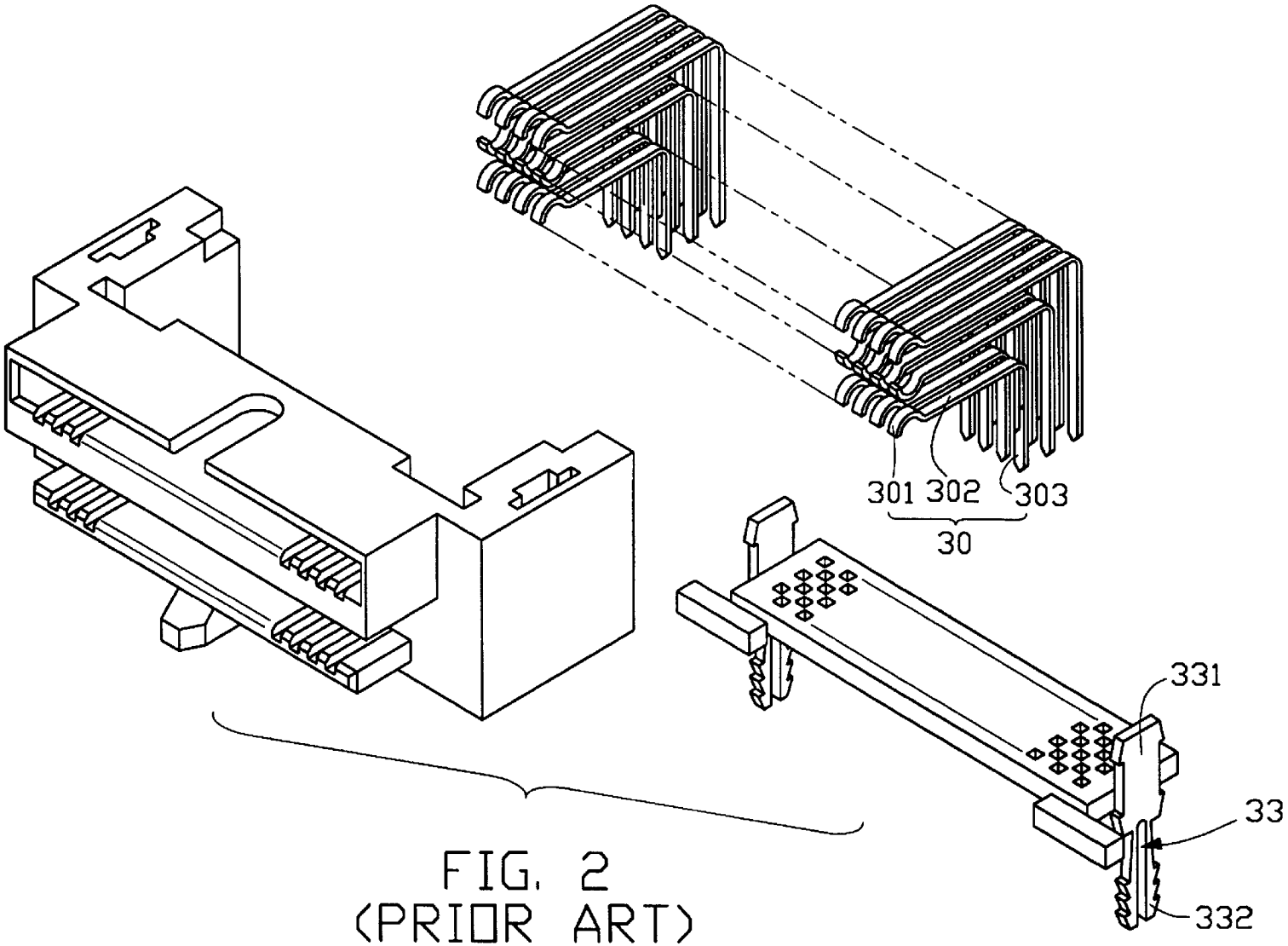
FIG. 2 (PRIOR ART)
FIG. 2 is an exploded view of another conventional connector.
Figure 3:
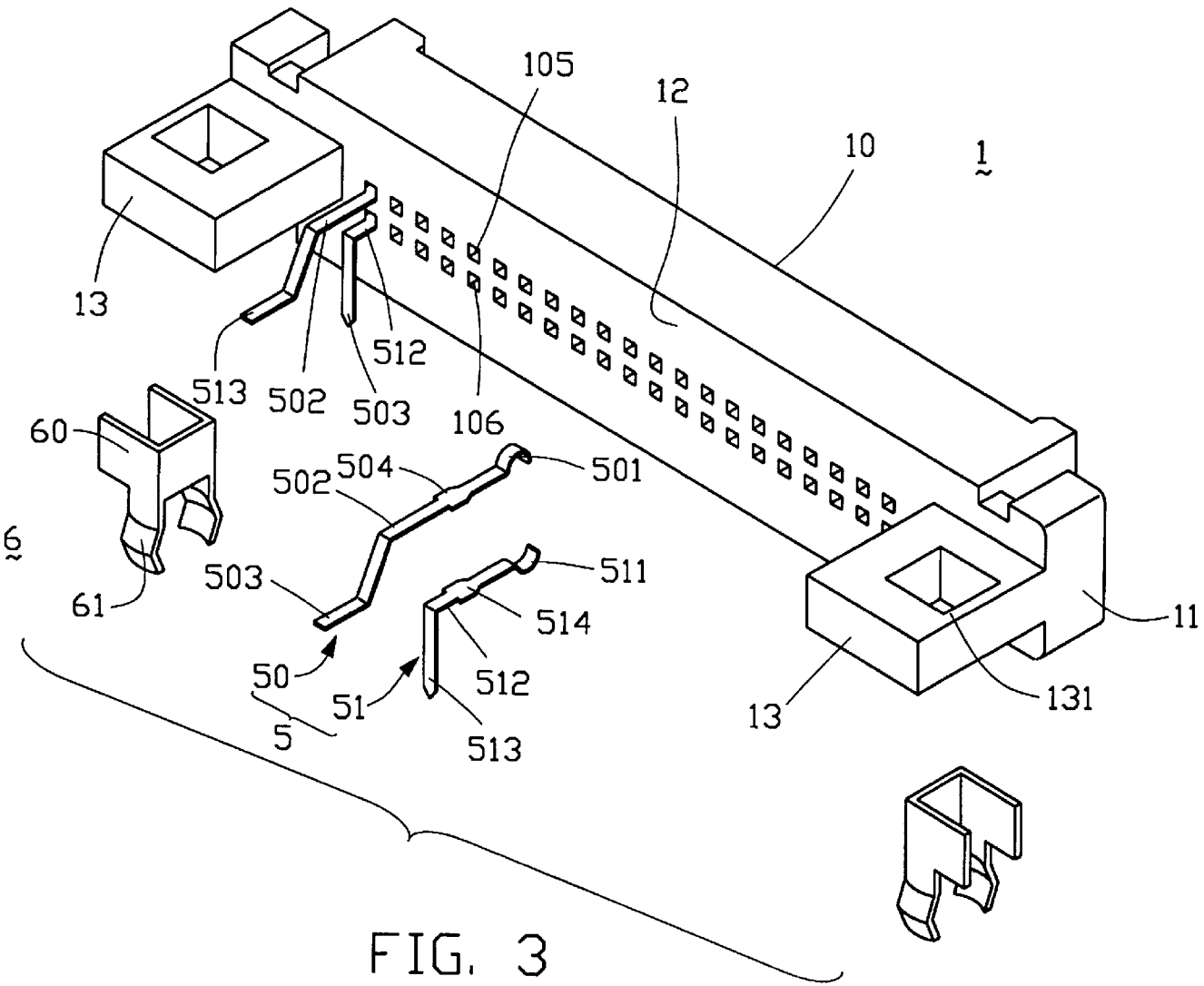
FIG. 3 is an exploded view of an electrical connector in accordance with the present invention.
Figure 4:
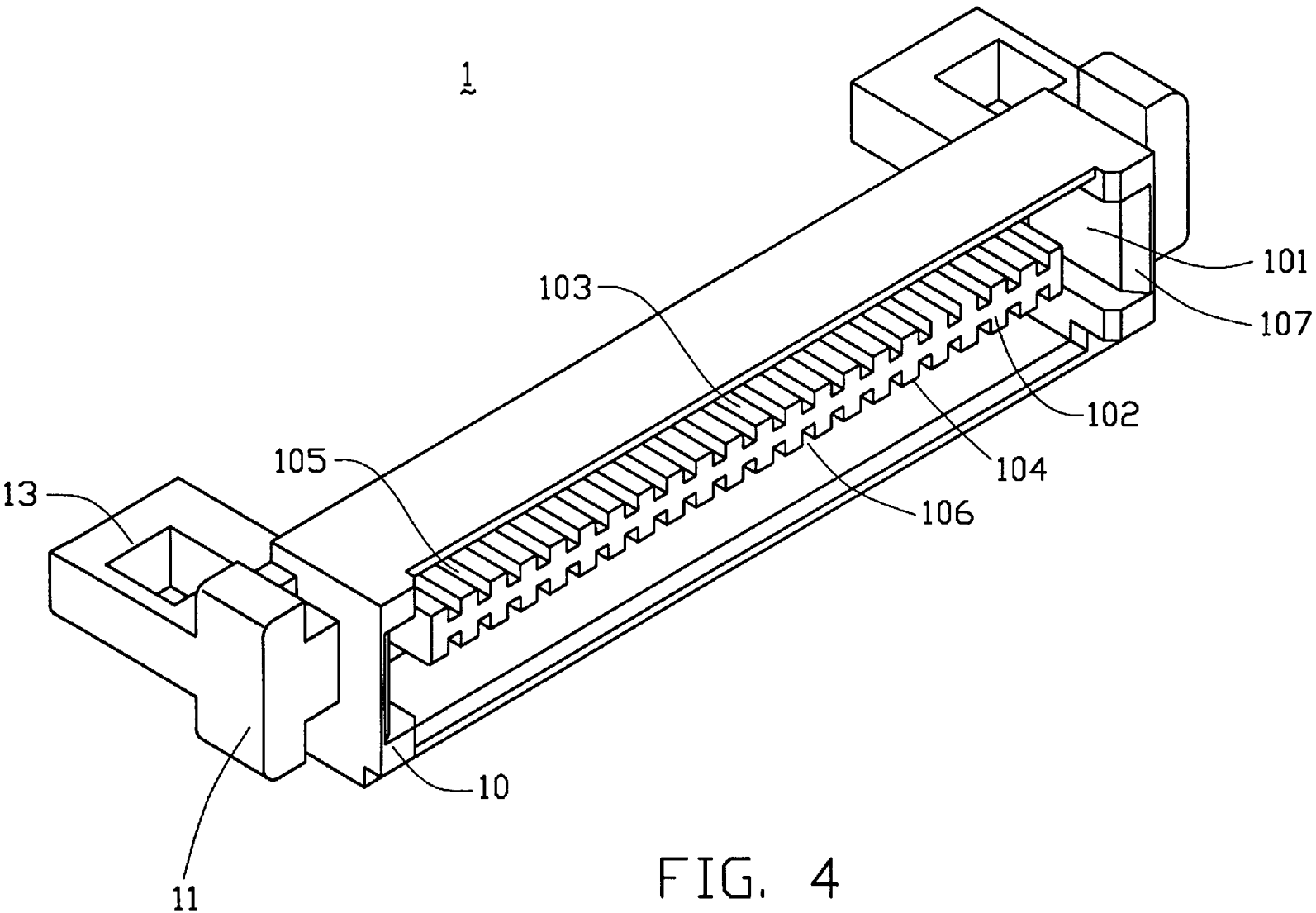
FIG. 4 is a perspective view of an insulative housing of the connector of the present invention.

Referring to FIGS. 3 and 4, an electrical connector in accordance with the present invention comprises an insulative housing 1, a plurality of conductive terminals 5 and a pair of board locks 6. The housing 1 has a front surface 10 and rear surface 12. An elongate groove 101 is defined in the front surface 10. An elongate mating projection 102 outwardly extending from the groove 101 defines a plurality of upper passageways 105 and lower passageways 106 in upper and lower surfaces 103, 104 thereof, respectively. The passageways 105, 106 extend to the rear surface 12 of the housing 1 for accommodating the corresponding terminals 5. The groove 101 forms an inclined face 107 in a lateral end thereof for guiding a mating connector (not shown). A T-shaped stop block 11 outwardly extends from each lateral end of the housing 1. A pair of retaining blocks 13 rearwardly extends from the rear surface 12 of the housing 1 proximate the lateral ends thereof. Each retaining block 13 defines an aperture 131 therethrough.

Figure 5:
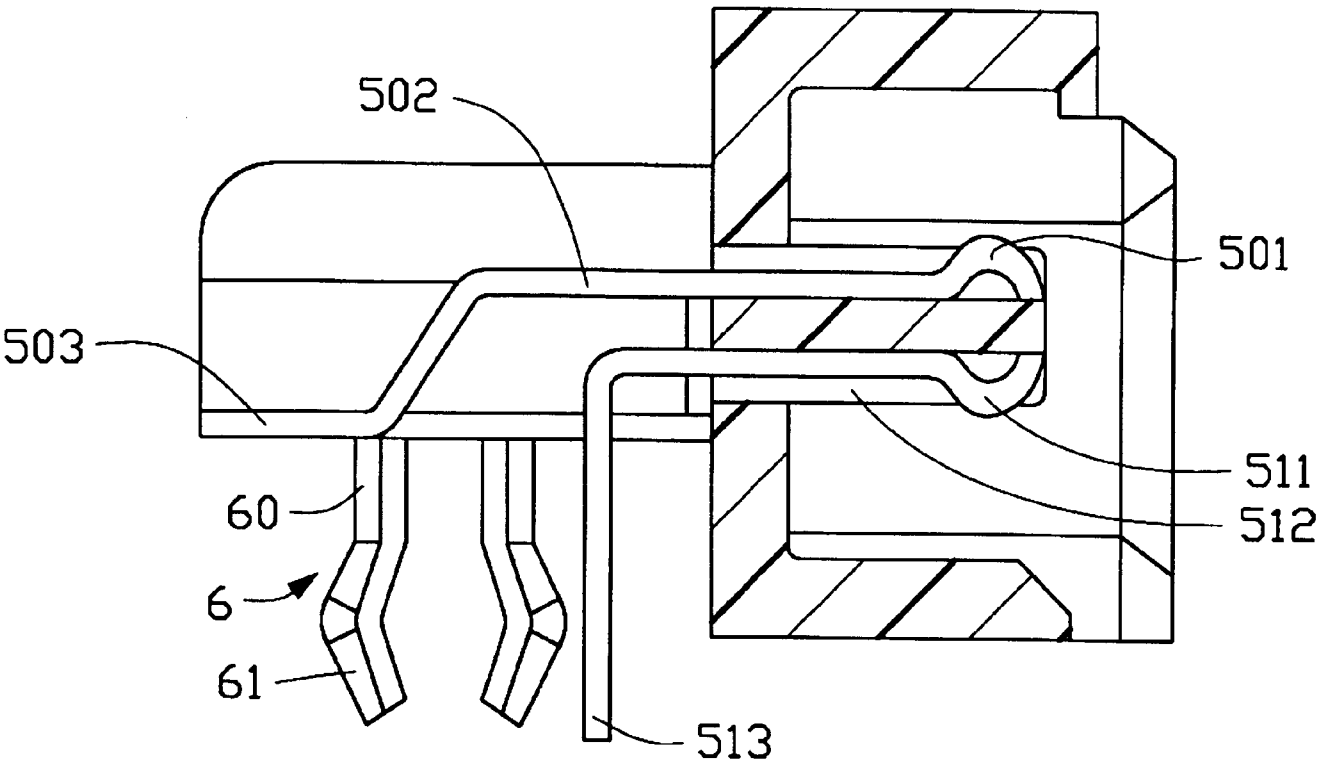
FIG. 5 is cross-sectional view of the assembled connector of the present invention.

Also referring to FIG. 5, the terminals 5 include upper terminals 50 and lower terminals 51. Each upper terminal 50 received in the corresponding upper passageway 105 includes an arcurate contact end 501, a securing portion 502 and a solder tail 503. The securing portion 502 forms a pair of barbs 504 for being interferentially fit in the upper passageway 105. The solder tail 503 is substantially parallel to a circuit board (not shown) and soldered to soldering sites located on an upper surface thereof using Surface Mounting Technology. Each lower terminal 51 received in the corresponding lower passageway 106 includes an arcurate contact end 511, a securing portion 512 and a solder tail 513. The securing portion 512 forms a wider portion 514 for being interferentially fit in the lower passageway 106. The solder tail 513 is substantially perpendicular to the circuit board and soldered to soldering sites located on a lower surface thereof using Through Hole Technology. Since the solder tails 503, 513 of the upper and lower terminals 50, 51 are soldered to opposite surfaces of the circuit board, the solder sites are not arranged in a high density thereby facilitating the soldering process easily and reliably.

Each board lock 6 includes a U-shaped retaining portion 60 and a pair of locking legs 61 integrally extending downward from a lower edge of the retaining portion 60. The retaining portion 60 is interferentially fit in the aperture 131 of the housing 1. Each locking leg 61 has an arcuate contact surface for fully engaging with an inner surface of a hole defined in the circuit board thereby reliably securing the housing 1 to the circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

We claim:

1. An electrical connector mounted on a circuit board, comprising:

an insulative housing having a front surface and a rear surface, a groove being defined in the front surface, a mating projection outwardly extending from the groove, a plurality of upper and lower passageways being defined in an upper surface and a lower surface of the projection and extending in a front-to-back direction; and a plurality of terminals including upper terminals and lower terminals respectively received in the upper and lower passageways, each upper terminal including a contact end, a securing portion and a solder tail substantially parallel to the circuit board and soldered to soldering sites on an upper surface thereof using Surface Mount Technology, each lower terminal including a contact end, a securing portion and a solder tail substantially perpendicular to the circuit board and soldered to soldering sites on a lower surface thereof using Through Hole Technology at the same side of the housing with the terminals soldered using Surface Mount Technology;

wherein a retaining block rearwardly extends proximate a lateral end of the housing with an aperture defined therethrough, the connector further comprising a board lock including a retaining portion received in the aperture of the retaining block and a pair of locking legs each having an arcuate surface for fully engaging with a hole defined in the circuit board thereby securing the connector to the circuit board, the board lock being positioned between the solder tails of the upper terminals and the solder tails of the lower terminals in said front-to-back direction.

2. The electrical connector a circuit board as claimed in claim 1, wherein the retaining portion of the board lock is U-shaped.

3. The electrical connector and circuit board as claimed in claim 1, wherein an inclined face is formed proximate a lateral end of the groove of the housing for guiding a mating connector.

4. The electrical connector and circuit board as claimed in claim 1, wherein a T-shaped stop block outwardly extends from a lateral end of the housing.

5. An electrical connector mounted on a printed circuit board, comprising:

an insulative housing defining a plurality of upper and lower passageways extending therethrough in a front-to-back direction;

a plurality of terminals including upper terminals and lower terminals respectively received within the upper and lower passageways, each upper terminal including a contact end, a securing portion and a solder tail substantially parallel to the circuit board and soldered to soldering sites on an upper surface thereof using Surface Mount Technology, each lower terminal including a contact end, a securing portion and a solder tail substantially perpendicular to the circuit board and soldered to soldering sites on a lower surface thereof using Through Hole Technology at the same side of the housing with the terminals soldered using Surface Mount Technology, wherein the connector further includes at least a board lock with two spaced locking legs thereof arranged to be aligned with each other along said front-to-back direction, and being positioned between the solder tails of the upper terminals and the solder tails of the lower terminals in said front-to-back direction.

* * * * *